US008708202B2

(12) United States Patent
Robertson et al.

(10) Patent No.: US 8,708,202 B2
(45) Date of Patent: Apr. 29, 2014

(54) PRESSURE CANISTERS FOR AUTOMATED DELIVERY OF COATING COMPOSITIONS

(75) Inventors: Walter James Robertson, Pittsburgh, PA (US); Melanie Sue Campbell, Sarver, PA (US); John Ritnell Oster, Jr., Butler, PA (US); Joseph S. Szul, Jr., Canfield, OH (US); Richard J. Foukes, Mars, PA (US)

(73) Assignee: PPG Industries Ohio, Inc., Cleveland, OH (US)

( * ) Notice: Subject to any disclaimer, the term of this patent is extended or adjusted under 35 U.S.C. 154(b) by 207 days.

(21) Appl. No.: 13/104,043

(22) Filed: May 10, 2011

(65) Prior Publication Data

US 2012/0285984 A1 Nov. 15, 2012

(51) Int. Cl.
*B65D 83/00* (2006.01)

(52) U.S. Cl.
USPC ..... 222/400.7; 222/148; 222/225; 222/108; 134/170

(58) Field of Classification Search
USPC ..... 222/400.7, 148, 394, 325; 137/206, 137/209; 118/302, 629, 429; 239/104, 106, 239/108, 110, 112, 113
See application file for complete search history.

(56) References Cited

U.S. PATENT DOCUMENTS 3,065,886 A * 11/1962 Smalley, Jr ..... 222/400.7
3,135,438 A * 6/1964 Wex et al. ..... 222/400.7
3,199,451 A 8/1965 Nitchie
3,674,205 A 7/1972 Kock
4,187,122 A * 2/1980 Query ..... 134/95.3
4,231,392 A 11/1980 Allibert
4,390,126 A 6/1983 Buchholz et al.
4,526,191 A 7/1985 Pomponi, Jr.
4,535,693 A 8/1985 Belvederi
4,627,465 A 12/1986 Kolibas et al.
4,705,083 A 11/1987 Rossetti
5,078,302 A 1/1992 Hellenberg
5,083,591 A 1/1992 Edwards et al.
5,184,051 A 2/1993 Schweiker et al.
5,286,302 A * 2/1994 Wickham, III ..... 134/22.1
5,876,512 A * 3/1999 Desormeaux et al. ..... 134/22.18
6,550,643 B1 * 4/2003 Foster et al. ..... 222/63
7,140,167 B2 * 11/2006 Countz ..... 53/510
7,216,655 B2 * 5/2007 Halbmaier et al. ..... 134/170
7,250,464 B2 7/2007 Friel et al.
7,367,473 B2 5/2008 Meschiari (Continued)

FOREIGN PATENT DOCUMENTS

EP 0059928 A1 9/1982
WO 2010074813 A1 7/2010
WO 2010091416 A1 8/2010
WO 2010091418 A1 8/2010

*Primary Examiner* — Paul R Durand
*Assistant Examiner* — Jeremy W Carroll
(74) *Attorney, Agent, or Firm* — Alan G. Towner

(57) ABSTRACT

Systems for delivering coating compositions are disclosed. The system may include a support base for supporting a container of a coating composition and a pressure canister movable in relation to the support base from an open position to a closed position in which the pressure canister surrounds the coating composition container and forms a seal with the support base. The system may include a pressure canister that is movable from a delivery position in which the canister is pressurized to a cleaning position in which the canister may be cleaned by a cleaning fixture. The pressure canisters are useful in automated systems for delivering various types of coating formulations.

28 Claims, 8 Drawing Sheets

(56) References Cited

U.S. PATENT DOCUMENTS

| | | | | |
|---|---|---|---|---|
| 7,575,114 | B2 * | 8/2009 | Buchko | 198/867.14 |
| 7,612,129 | B2 | 11/2009 | Friel et al. | |
| 7,698,021 | B2 | 4/2010 | Hughes et al. | |
| 7,793,676 | B2 | 9/2010 | Albrecht et al. | |
| 2006/0087914 | A1 | 4/2006 | Eckart | |
| 2008/0262652 | A1 | 10/2008 | Eriksson | |
| 2008/0305241 | A1 | 12/2008 | Trevino, III et al. | |
| 2009/0074979 | A1 | 3/2009 | Krogedal et al. | |
| 2009/0099695 | A1 | 4/2009 | Trevino, III et al. | |
| 2009/0112371 | A1 | 4/2009 | Hughes et al. | |
| 2009/0204260 | A1 | 8/2009 | Bryne et al. | |
| 2009/0228143 | A1 | 9/2009 | Hughes et al. | |
| 2009/0228367 | A1 | 9/2009 | Hughes et al. | |
| 2009/0240363 | A1 | 9/2009 | Hughes et al. | |
| 2009/0242583 | A1 | 10/2009 | Elberson | |
| 2010/0030381 | A1 | 2/2010 | Clifford et al. | |
| 2010/0161141 | A1 | 6/2010 | Herre et al. | |

* cited by examiner

PRESSURE CANISTERS FOR AUTOMATED DELIVERY OF COATING COMPOSITIONS

FIELD OF THE INVENTION

The present invention relates to pressure canisters for delivering coating compositions, and more particularly relates to coating composition pressure canisters useful in automated systems for delivering various types of coating formulations.

BACKGROUND OF THE INVENTION

Pressure pot systems have been used for various coating applications. A cup or similar container holding a coating composition is placed inside a pressure vessel comprising a cylindrical can or pot with a sealable lid. After the container is placed in the pot, the lid is manually sealed to the pot by mechanical fasteners such as c-clamps or the like. A pressure line running through the lid is used to pressurize the sealed pot, and a stem running through the lid down into the container is used to draw the coating composition under pressure from the container to a delivery system such as a sprayer.

Although conventional pressure pot systems are useful for many applications, it would be desirable to provide an improved pressure canister system capable of automated delivery of coating compositions. For example, automated color formulation systems would benefit from such a pressure canister.

SUMMARY OF THE INVENTION

An aspect of the invention provides a system for pressurized delivery of coating compositions comprising a support base structured and arranged to support a container of a coating composition, and a pressure canister movable in relation to the support base from an open position to a closed position in which the pressure canister surrounds the coating composition container and forms a seal with the support base.

Another aspect of the invention provides a system for pressurized delivery of coating compositions comprising a pressure canister automatically movable from a delivery position in which the pressure canister is pressurized for delivery of the coating composition to a cleaning position in which at least a portion of the pressure canister is cleaned by a cleaning fixture.

A further aspect of the invention provides an automated method for pressurized delivery of coating compositions. The method includes the steps of placing a container of a coating composition on a support base, moving a pressure canister in relation to the support base to a position in which the pressure canister surrounds the coating composition container and forms a seal with the support base, pressurizing the pressure canister, and delivering the coating composition under pressure from the pressure canister through a hollow stem mounted on the pressure canister and extending into the coating composition container.

DETAILED DESCRIPTION OF EMBODIMENTS OF THE INVENTION

Figure 1:
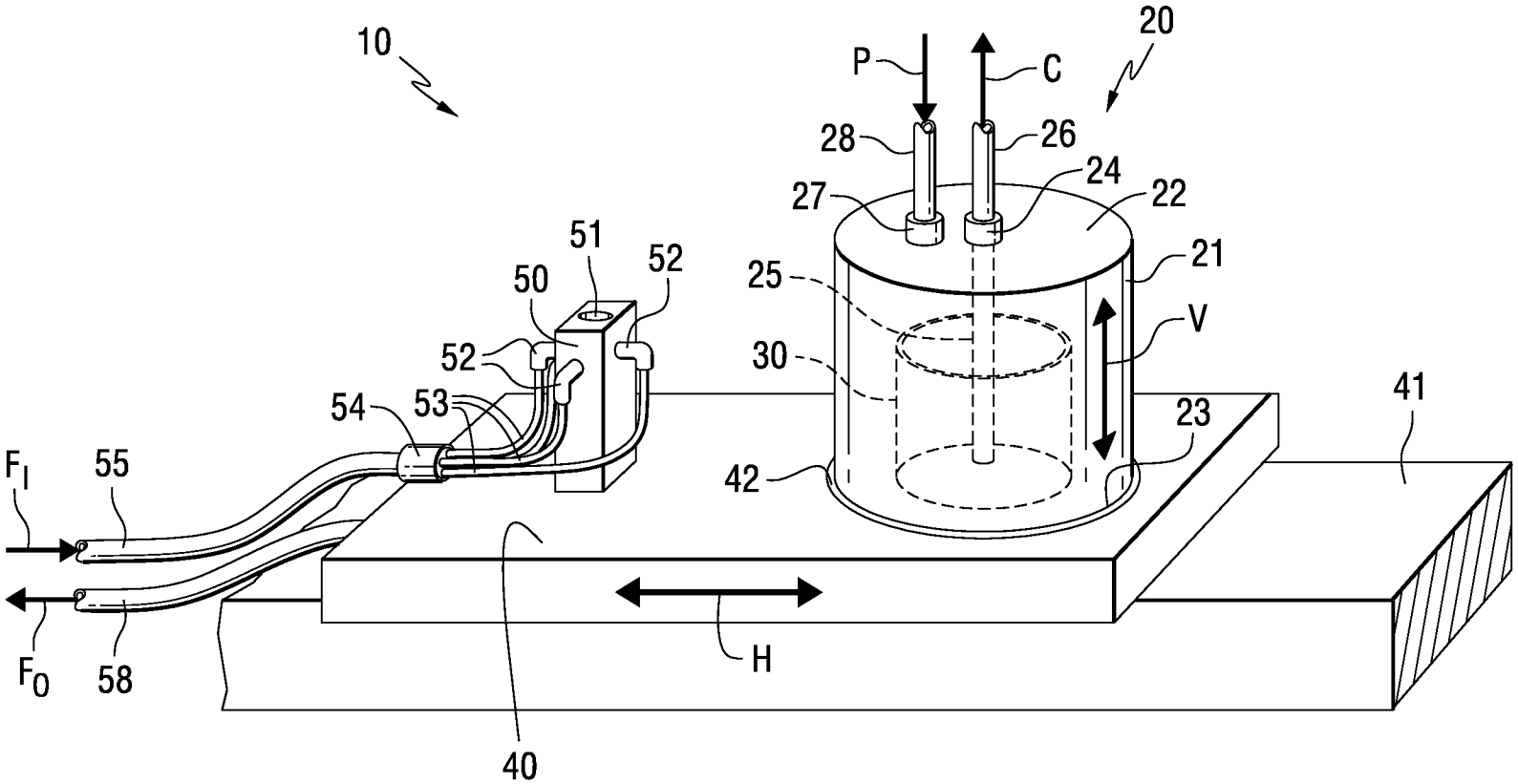
FIG. 1 is a partially schematic isometric view of a system for pressurized delivery of coating compositions in accordance with an embodiment of the present invention.
Figure 2:
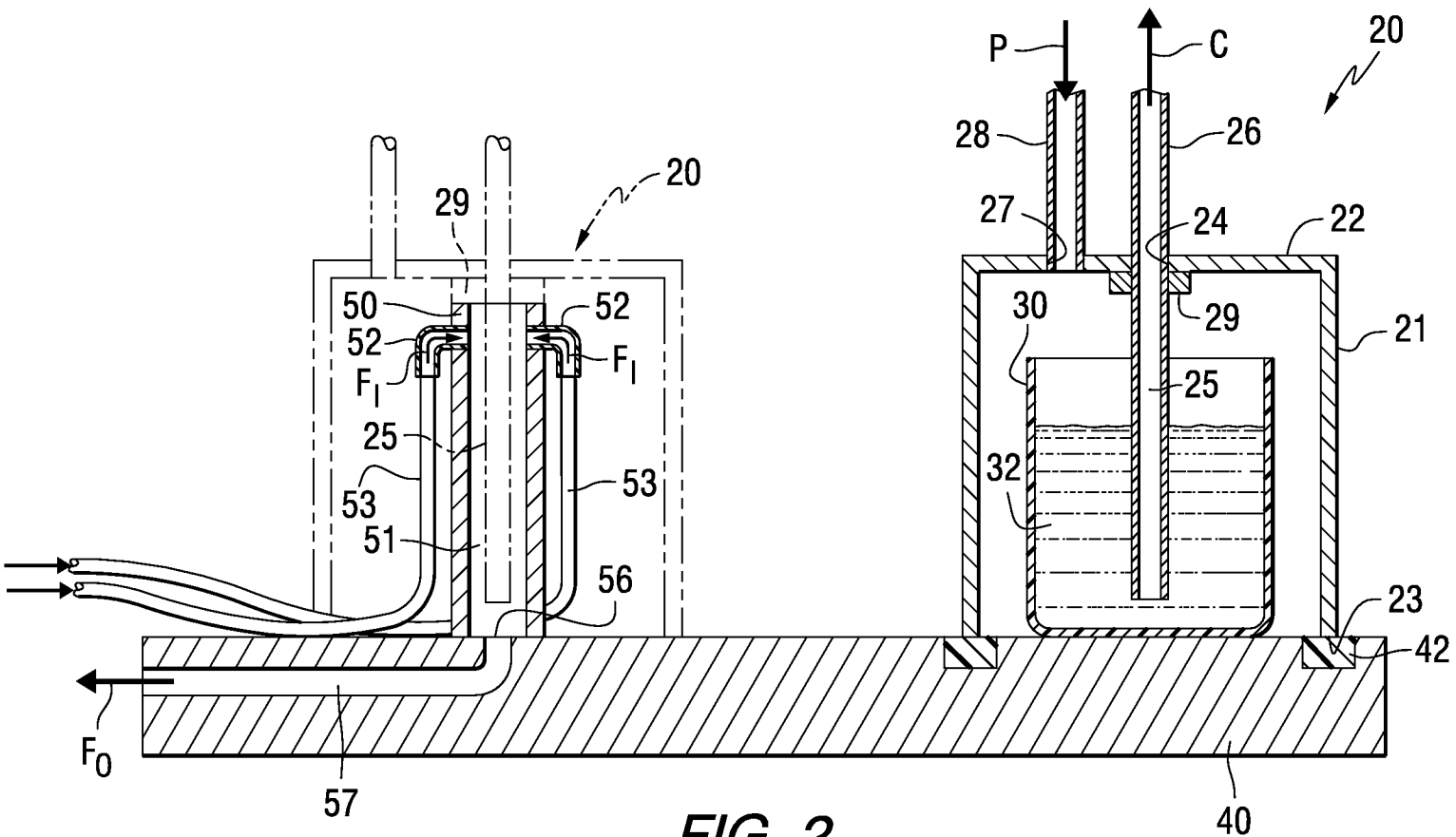
FIG. 2 is a sectional view of the system shown in FIG. 1.

FIGS. 1 and 2 schematically illustrate a system 10 for pressurized delivery of coating compositions in accordance with an embodiment of the present invention. The system 10 includes a pressure canister 20 and is capable of automated delivery of pressurized coating compositions. A coating composition container 30 is placed on a support base 40, and then moved in a horizontal direction H to a position under the pressure canister 20. The pressure canister 20 is lowered in a vertical direction V to form a seal against the support base 40. The pressure canister 20 is then pressurized and the coating composition is delivered from the pressure canister 20 to a selected application device (not shown). After the desired amount of coating composition has been delivered, the pressure canister 20 is raised in the vertical direction V, and then the support base 40 is moved in the horizontal direction H to a position in which a cleaning fixture 50 is positioned below the pressure canister 20. The pressure canister 20 is then lowered around the cleaning fixture 50 to clean the components of the pressure canister 20, as more fully described below.

As shown in FIGS. 1 and 2, the pressure canister 20 comprises a sidewall 21, top 22 and lower sealing edge 23. The pressure canister 20 includes a coating composition delivery port 24, a hollow stem 25 and a delivery line 26 through which a coating composition may be removed from the pressure canister 20 and delivered to any suitable application device (not shown). The pressure canister 20 also includes a pressure port 27 connected to a pressure line 28 through which a source of pressurized gas P may flow. A baffle (not shown) may be installed at the end of the pressure port 27 to diffuse or direct the flow of pressurized gas P as it enters the interior of the pressure canister 20. A gasket 29 surrounding the stem is positioned inside the pressure canister 20 against the top 22 of the canister.

As shown by dashed lines in FIG. 1, and further shown in cross section in FIG. 2, the coating composition container 30 is positioned inside the pressure canister 20. The container 30 holds a coating composition 32 having any desired formulation, as more fully described below. The container 30 rests on the support base 40, which is movable in the horizontal travel direction H on a support track 41. In the embodiment shown in FIGS. 1 and 2, an elastomeric ring 42 is mounted in an annular recess in the support base 40. When the pressure canister 20 is positioned as shown in FIGS. 1 and 2, its lower edge 23 forms a seal against the elastomeric ring 42. In this position, when the pressurized gas P is introduced into the pressure canister 20 through the pressure line 28, the coating composition 32 in the container 30 is forced upward through the stem 25 and through the delivery line 26 to provide a flow of the coating composition C to the desired application device (not shown).

As further shown in FIGS. 1 and 2, the cleaning fixture 50 is mounted on the support base 40 at a different horizontal position than the elastomeric ring 42 and the area where the container 30 is supported. The cleaning fixture 50 includes a hollow cleaning chamber 51 that is structured and arranged to receive the stem 25 of the pressure canister 20 when the system is in the cleaning position, as shown in phantom in FIG. 2. As can be seen in FIG. 2, the stem 25 fits within the cleaning chamber 51 with sufficient clearance to allow a cleaning fluid to contact the stem 25, as more fully described below. The gasket 29 surrounding the top of the stem 25 contacts the top of the cleaning fixture 50.

The cleaning fixture 50 includes cleaning nozzles 52 communicating with the cleaning chamber 51. In the embodiment shown in FIGS. 1 and 2, four cleaning nozzles 52 are provided at 90 degree intervals around the cleaning fixture 50. However, any other suitable number and arrangement of cleaning nozzles, or other cleaning fluid delivery fixtures, may be used in accordance with the present invention. Cleaning fluid delivery lines 53 feed into the nozzles 52 through a manifold 54. Cleaning fluid $F_1$ flows into the manifold 54 through a cleaning fluid supply line 55. The gasket 29 prevents the cleaning fluid $F_1$ from flowing out through the top of the cleaning chamber 51. As shown in FIG. 2, a drain 56 is provided at the bottom of the cleaning chamber 51. A conduit 57 through the support base 40 discharges the used cleaning fluid $F_O$ through an outlet line 58.

The various components of the system 10 of the present invention may be made from suitable materials known to those skilled in the art, including various metals, polymers and the like. Although the stem 25 is primarily described herein as being a reusable component that may be made from a suitable material such as stainless steel or aluminum capable of withstanding multiple cleaning operations, it is to be understood that the stem 25 may be disposable in certain embodiments of the invention, in which case a new stem may be installed during each cycle of the system.

Figure 5:
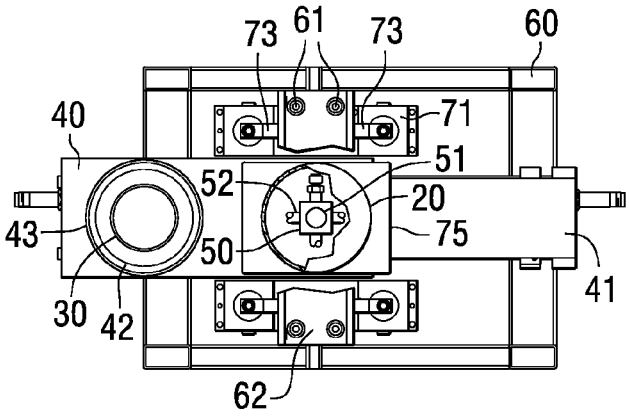
FIG. 5 is a top view of the system shown in FIG. 3.
Figure 4:
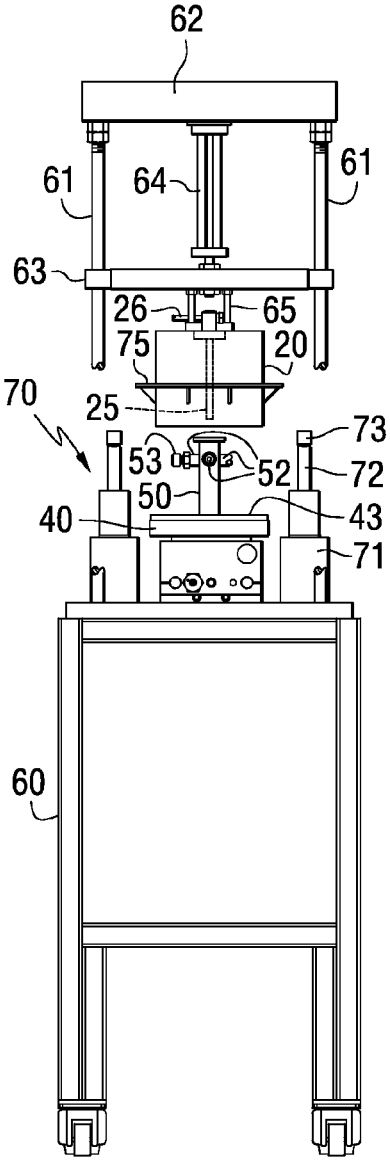
FIG. 4 is a side view of the system shown in FIG. 3.
Figure 3:
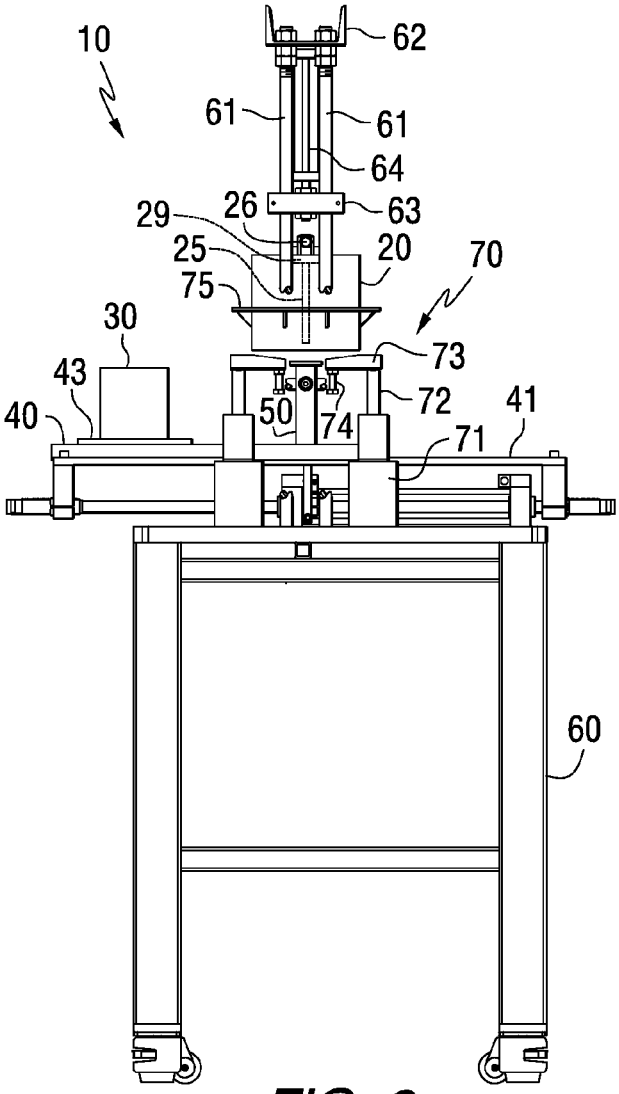
FIG. 3 is a front view of a system for pressurized delivery of coating compositions in accordance with an embodiment of the present invention.
Figure 8:
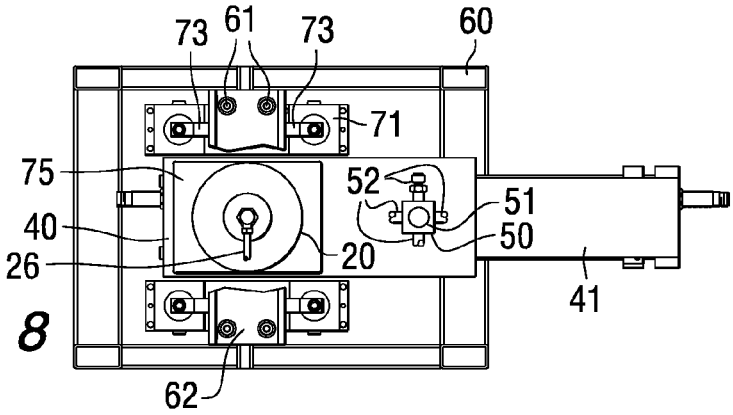
FIGS. 6, 7 and 8 are front, side and top views, respectively, of the system shown in FIGS. 3-5, with a support base of the system moved to a different horizontal position.
Figure 7:
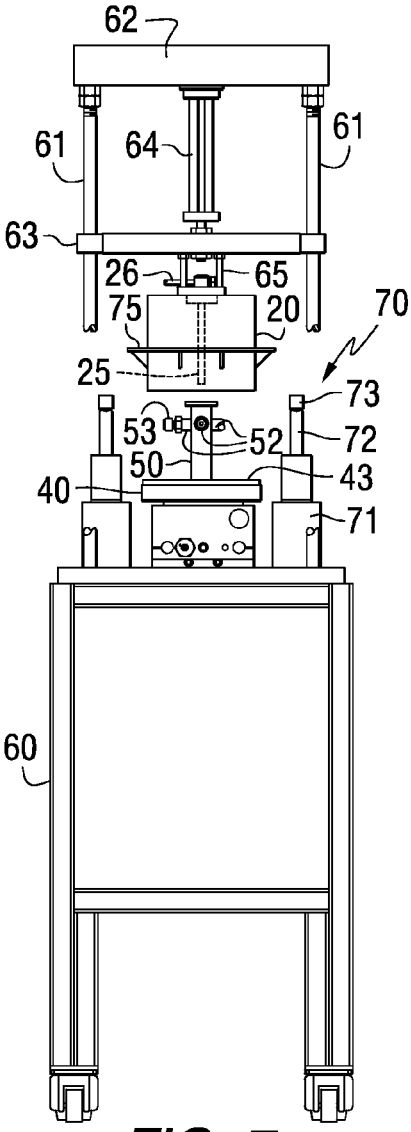
Figure 6:
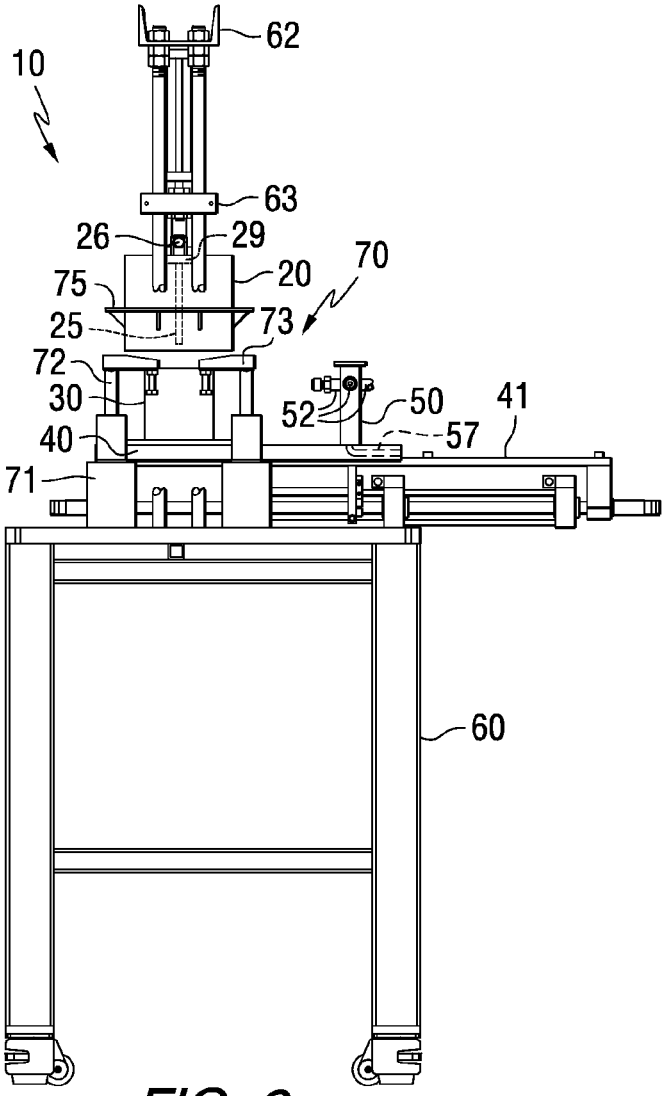
Figure 9:
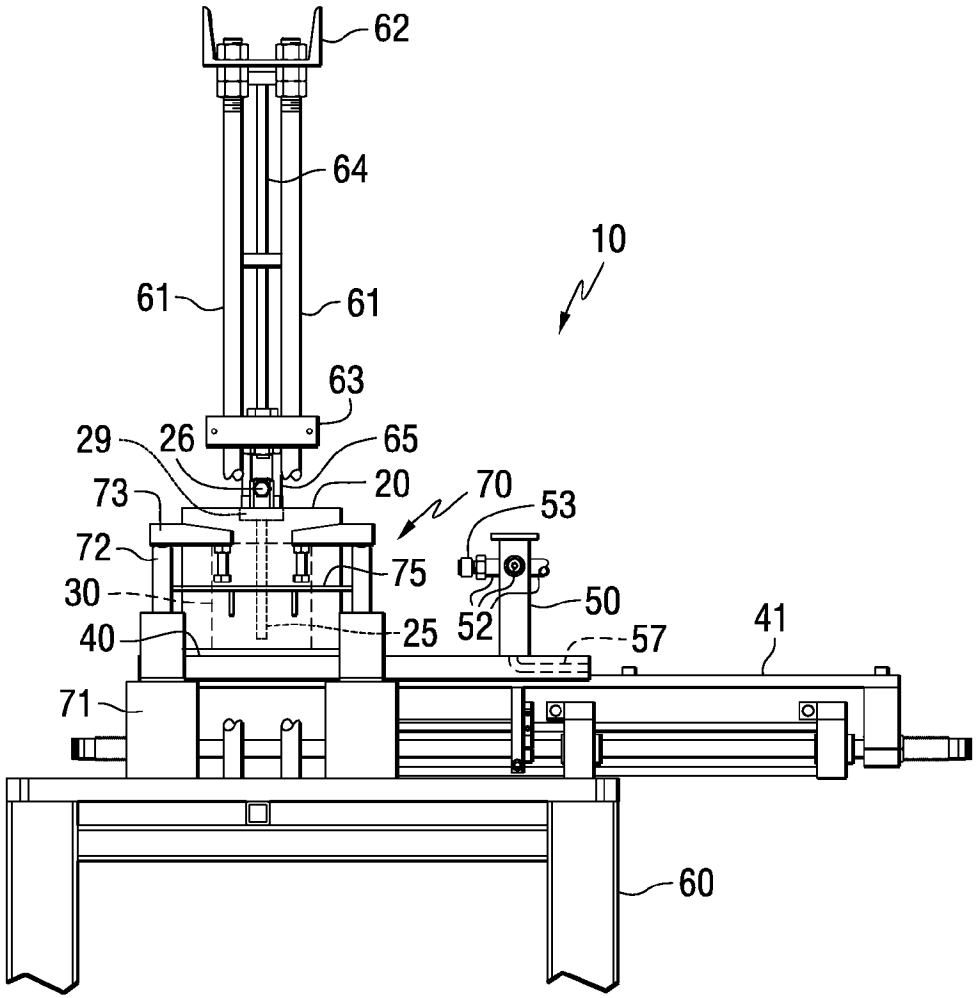
FIGS. 9 and 10 are front and side views, respectively, of the system shown in FIGS. 6-8, with a pressure canister of the system moved to a different vertical position.
Figure 10:
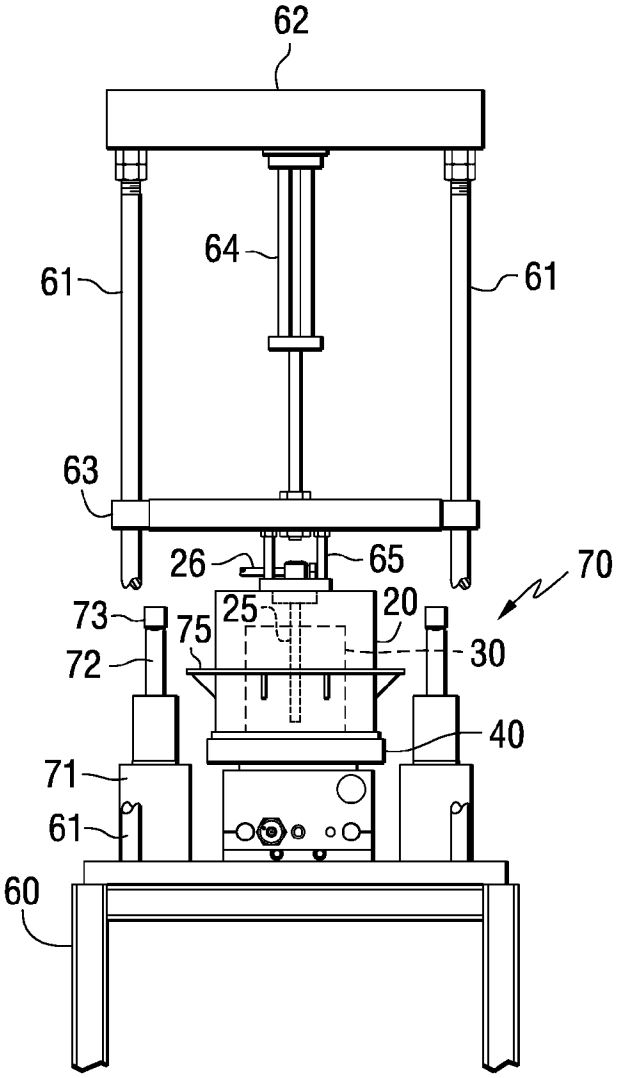
Figure 11:
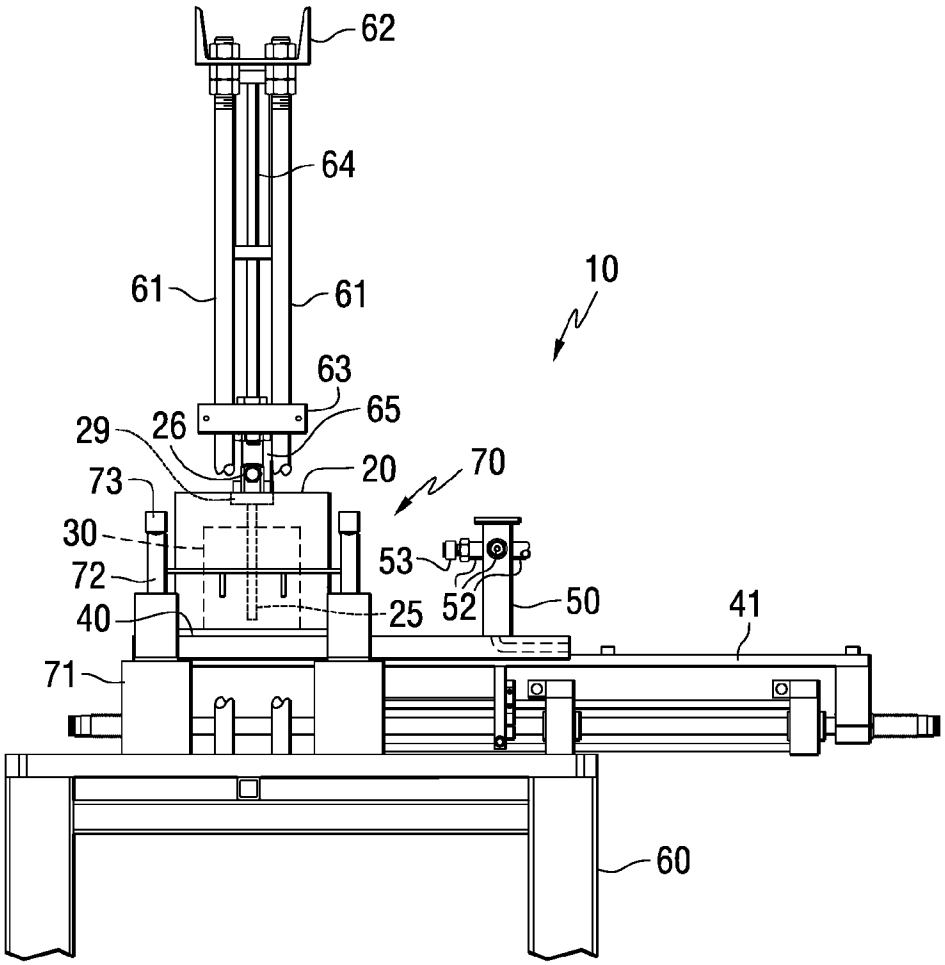
FIGS. 11 and 12 are front and side views, respectively, of the system shown in FIGS. 9 and 10, with clamping members of the system moved into engagement with the pressure canister.
Figure 12:
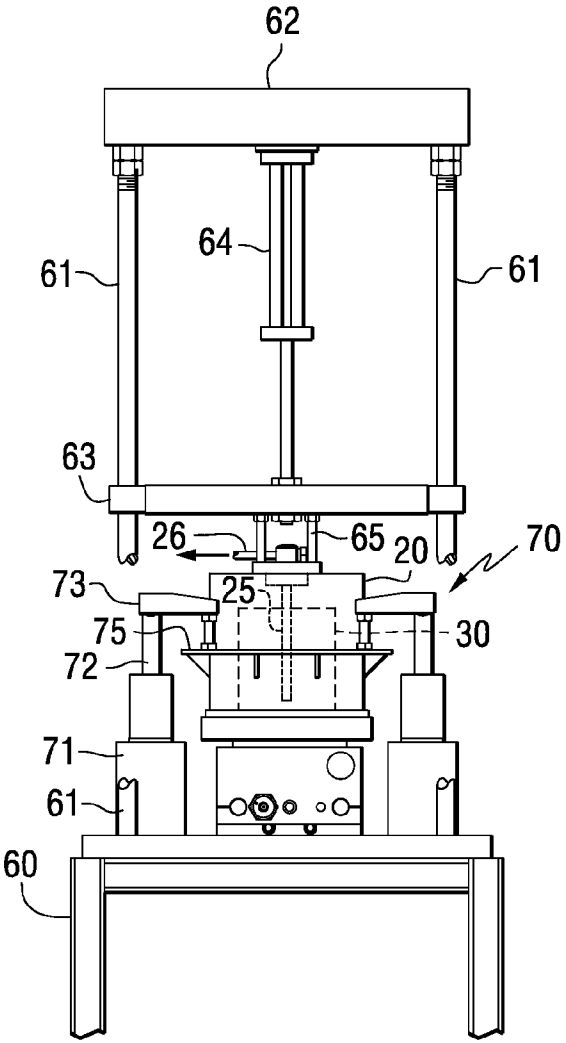
Figure 13:
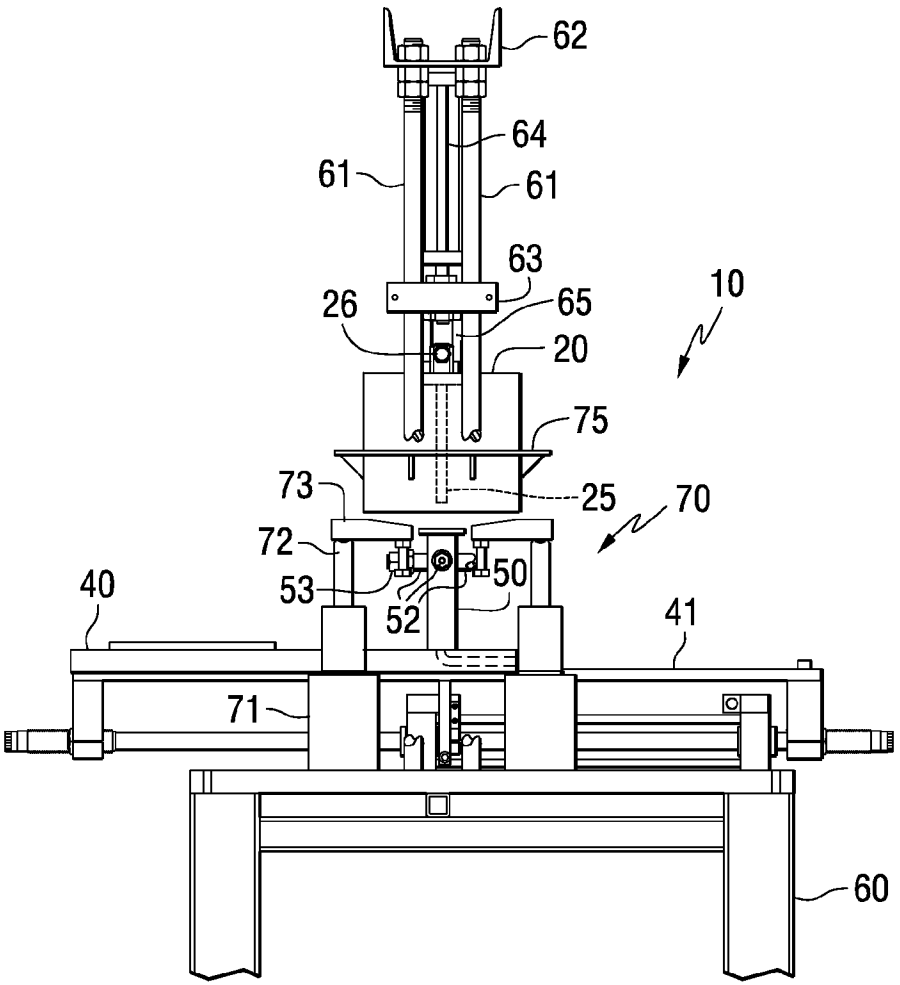
FIGS. 13 and 14 are front and side views, respectively, of the system shown in FIGS. 11 and 12, with the pressure canister raised and the support base moved to a different horizontal position in which a cleaning fixture is located below the pressure canister.
Figure 14:
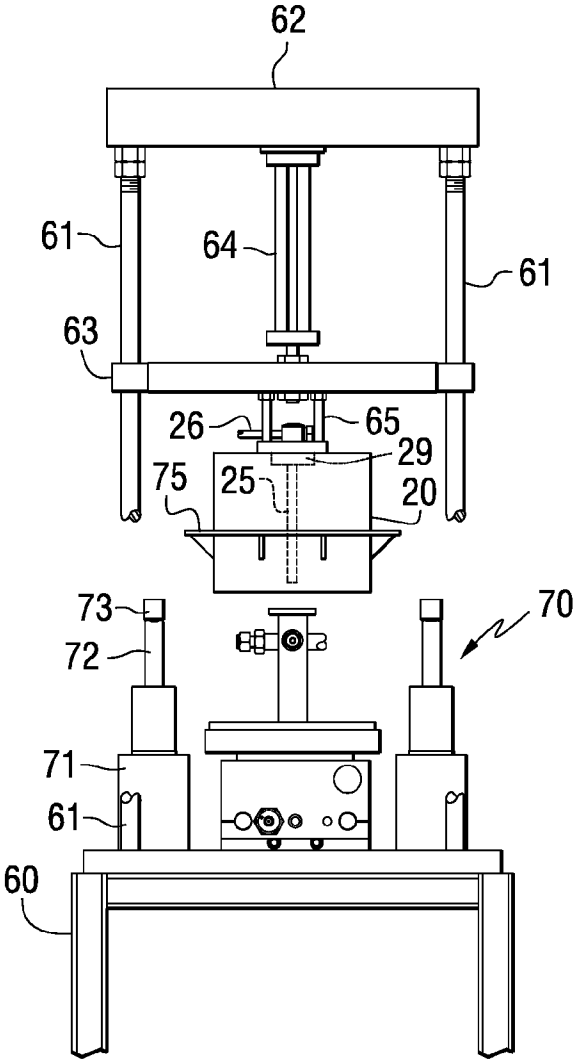

FIGS. 3-15 illustrate a system for pressurized delivery of coating compositions in accordance with certain embodiments of the invention. In FIGS. 3-5, the system is in an initial staging position in which the container 30, holding a desired amount and formulation of coating composition, is placed on the support base 40. FIGS. 6-8 illustrate another position of the system in which the support base 40 has been moved horizontally H to a position where the container 30 is located below the raised pressure canister 20. In FIGS. 9 and 10, the pressure canister 20 has been lowered from the position shown in FIGS. 6-8 to a position in which the pressure canister 20 contacts the support base 40. FIGS. 11 and 12 are similar to FIGS. 9 and 10, except automatic clamp assemblies 70 have been engaged to force the pressure canister 20 downward against the support base 40, thereby forming a seal that helps to maintain pressure inside the pressure canister 20 during delivery of the coating composition. In FIGS. 13 and 14, the clamp assemblies 70 have been disengaged, the pressure canister 20 has been raised in the vertical direction V, and the support base 40 has been moved in the horizontal direction H to a position in which the cleaning fixture 50 mounted on the support base 40 is positioned under the pressure canister 20. In the position shown FIG. 15, the pressure canister 20 has been lowered to a cleaning position in which the stem 25 of the pressure canister 20 is received within the cleaning chamber 51 of the cleaning fixture 50. After the cleaning operation, the pressure canister 20 may be moved vertically upward from the position shown in FIG. 15 to the position shown in FIG. 3 to complete the cycle.

Figure 15:
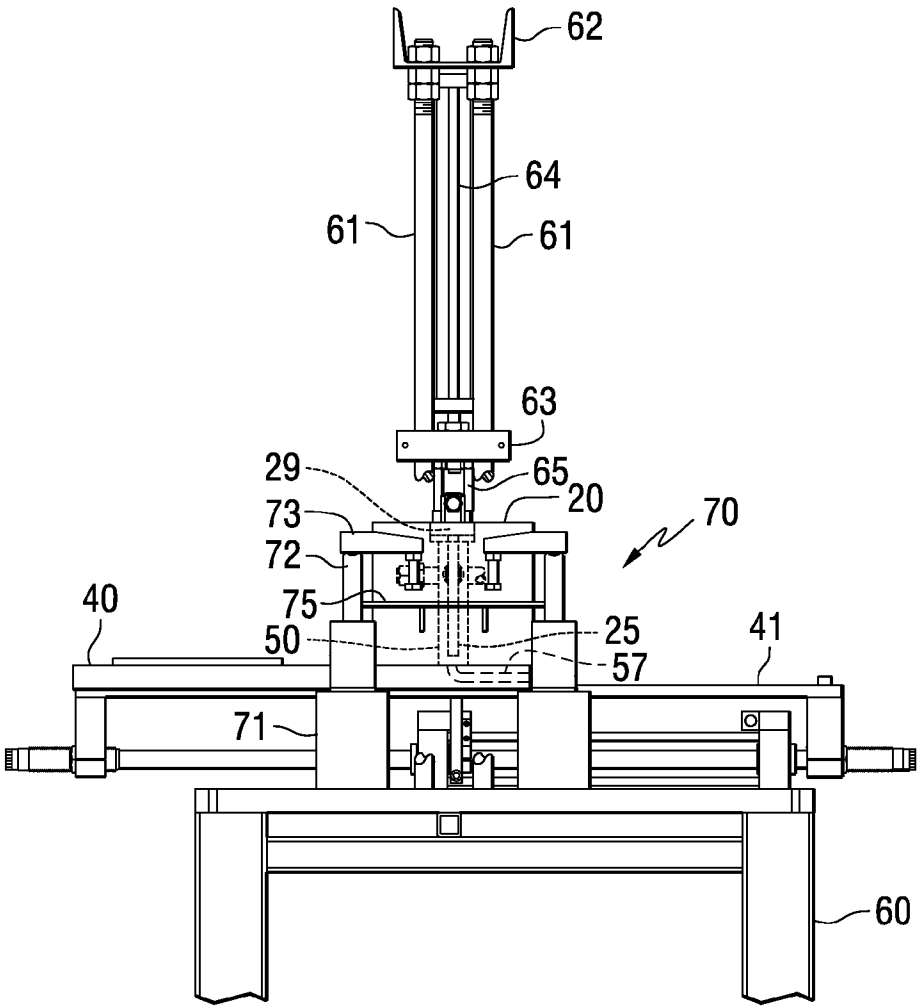
FIG. 15 is a front view of the system shown in FIG. 13, with the pressure canister moved downward into a cleaning position in relation to the cleaning fixture.

At any suitable time during the cycle, and preferably when the support base 40 is located in the position shown in FIGS. 13 and 15, the spent coating composition container 30 may be removed from the support base 40 and may be replaced with another filled container 30. In this manner, the containers 30 may be removed and replaced during the cleaning operation in order to increase the speed in which the system can deliver various types of coating compositions. Such removal and replacement may be done manually or, in certain embodiments, may be done automatically. For example, a robot arm (not shown) may be used to remove spent coating composition containers 30 from the support base 40 and/or to place filled containers 30 on the support base 40. The use of a substantially flat support base 40 facilitates efficient placement and removal of the coating composition containers 30 because the containers 30 may be placed on the support base 40 by relatively simple movement in a horizontal plane rather than by more complex movement involving vertical placement of the containers down into a pressure canister having sidewalls. For example, a robot arm may be rotated and/or translated in a substantially horizontal plane to place a container 30 on the support base 40 with little or no vertical movement required.

As shown in FIGS. 3-15, the system 10 may include a support table 60 having vertical support rods 61 mounted thereon. A horizontal support bar 62 is fastened to the tops of the support rods 61. A movable support bar 63 travels in a vertical direction along the support rods 61. An actuator 64 is used to raise and lower the movable support bar 63 in relation to the stationary horizontal support bar 62. A support bracket 65 fastened on the movable support bar 63 is mounted to and supports the pressure canister 20. Thus, the actuator 64 may be used to raise and lower the movable support bar 63, support bracket 65 and pressure canister 20. For purposes of illustration, portions of the support table 60, support rods 61, horizontal support bar 62, movable support bar 63, actuator 64 and support bracket 65 have been removed from some of the figures in order to more clearly show some of the other features of the system 10.

In the initial or staging position shown in FIGS. 3-5, the coating composition container 30 is placed on a disk 43 that is slightly elevated above the upper surface of the support base 40. In this embodiment, the disk 43 includes an elastomeric seal ring 42, as most clearly shown in FIG. 5, that is similar to the elastomeric ring 42 shown in FIGS. 1 and 2. Although a raised disk 43 is illustrated in FIGS. 3-5, it is to be understood that any suitable support structure may be used in accordance with the present invention. For example, the surface supporting the container 30 may be substantially flush with the upper surface of the support base 40, or may be recessed slightly therein. Furthermore, the elastomeric ring 42 shown in FIGS. 1, 2 and 5 may be eliminated or replaced with any other suitable elastomeric structure such as a continuous disk or sheet of elastomeric material that extends under the container 30. Such a continuous disk of elastomeric material may have an upper surface that is substantially flush with the upper surface of the support base 40, or may be raised slightly above or recessed slightly in the upper surface of the support base 40. Furthermore, an elastomeric material such as a seal ring may be mounted on or adjacent to the lower sealing edge 23 of the pressure canister 20 in order to help seal the pressure canister 20 against the support base 40. In this case, the seal ring on the lower edge 23 may be used in place of, or in addition to, the elastomeric ring 42 or elastomeric disk on the support base 40.

As shown most clearly in FIGS. 3 and 4, when the system 10 is in the initial staging position the pressure canister 20 is in a raised position and is located above the cleaning fixture 50 on the support base 40. As most clearly shown in FIGS. 3 and 5, the position of the support base 40 provides access for placement of the container 30 thereon.

When the system 10 is moved from the position shown in FIGS. 3-5 to the position shown in FIGS. 6-8, the support base 40 supports the container 30 under the raised pressure canister 20.

In the position shown in FIGS. 9 and 10, the pressure canister 20 has been lowered onto the upper surface of the support base 40, with the stem 25 of the pressure canister 20 extending down into the coating composition container 30 with the lower end of the stem 25 located close to the bottom of the container 30 with sufficient clearance to allow flow of the coating composition 32 from the container 30 upward through the stem 25.

In the position shown in FIGS. 11 and 12, the automatic clamp assemblies 70 are engaged. Each clamp assembly 70 includes a base 71 and a rotating and telescoping rod 72 having a clamp arm 73 and contact member 74 mounted thereon. The clamp assemblies 70 are engaged by rotating each clamp arm 73 ninety degrees and lowering each arm and associated contact member 74 against a ledge 75 of the pressure canister 20. Each clamp rod 72 telescopes within the base 71 to cause the clamp arm 73 and contact member 74 to press against the ledge 75 with sufficient force to seal the pressure canister 20 against the support base 40 to ensure that pressure is maintained inside the pressure canister 20 when the pressurized gas P is introduced into the pressure canister 20. The clamp rods 72 and clamp arms 73 may be actuated by any suitable type of actuator such as conventional pneumatically controlled solenoid actuators.

Although the clamp assemblies 70 shown in FIGS. 11 and 12 engage the ledge 75 on the pressure canister 20, any other suitable clamping arrangement may be used in accordance with embodiments of the present invention. For example, clamps or other types of mechanical fasteners may engage other parts of the pressure canister 20 or its support structure such as the movable support bar 63. Furthermore, the actuator 64 may be clamped or otherwise held in position to maintain the desired pressure level inside the pressure canister 20.

In the sealed position shown in FIGS. 11 and 12, the coating composition 32 is pressurized and forced from the pressure canister 20 through the delivery line 26 to any suitable type of application device (not shown). A typical pressure is from about 1 to about 100 psi, for example, from about 2 to about 50 psi. Examples of application devices that may be connected to the delivery line 26 include conventional sprayers, atomizers, rollers, brushes and the like. The coating compositions may be applied to any suitable type of substrate.

After the desired amount of coating composition is delivered, pressure may be relieved by disengaging the clamp assemblies and raising the pressure canister 20. The automatic clamp assemblies 70 are disengaged by raising and rotating the clamp rods 72 such that the clamp arms 73 are clear of the ledge 75 of the pressure canister 20. The system 10 may then be moved to the position shown in FIGS. 13 and 14 in which the cleaning fixture 50 is located below the raised pressure canister 20. The cleaning fixture 50 is used to clean the stem 25 in the position shown in FIG. 15.

During the cleaning operation, the stem 25 of the pressure canister 20 is positioned inside the cleaning chamber 51. Cleaning fluid is then delivered through the nozzles 52 to impinge upon the stem 25. In certain embodiments, it may be desirable to move the pressure canister 20 and stem 25 in the vertical direction V during the cleaning operation in order to direct the cleaning fluid against different sections of the stem 25 as it moves vertically in the cleaning chamber 51.

In addition to such spray-cleaning operations, any other suitable cleaning procedure may be used in accordance with the present invention. For example, the stem 25 may be immersed in a bath of the cleaning fluid using spray nozzles or any other suitable type of fluid delivery fixture to fill the interior chamber 51. The cleaning fluid may be at ambient temperature or may be heated. In certain embodiments, the cleaning fluid may comprise a mixture of liquid and gas, such as a foam or aerosol. Furthermore, the cleaning fluid may comprise a gas such as steam or the like directed toward the stem 25. When gas or any other pressurized fluid is used to clean the stem 25, the cleaning operation may be performed with or without a cleaning chamber 51 as shown in FIGS. 1 and 2. Other suitable cleaning processes for use in accordance with the present invention include mechanical means such as scrubbing or other physical removal of any residual coating composition from the stem 25 or other components of the pressure canister 20. Furthermore, vibration such as ultrasonic agitation may be applied to the stem 25 and other components of the pressure canister 20, typically in combination with immersion of the stem 25 in a suitable cleaning liquid. For example, a liquid solvent, which may be the same or different from a solvent contained in the coating composition, may be introduced into the cleaning chamber 51 of the cleaning fixture 50 and vibration at ultrasonic or other frequencies may be introduced into the cleaning liquid by any suitable known type of transducer.

In accordance with embodiments of the invention, the relative movement of the pressure canister 20 and support base 40 are conducted automatically by standard actuators and controllers known to those skilled in the art. For example, vertical movement of the pressure canister 20 and horizontal movement of the support base 40 may be accomplished with conventional pneumatically controlled solenoid actuators. The vertical and horizontal movements may be automatically controlled by any suitable controller such as a conventional programmable logic controller (PLC), CPU, PC and the like.

Any suitable coating composition may be used in the pressure canister system of the present invention. For example, some suitable solvent-based coating compositions include isocyanate hydroxyl, epoxy amine, anhydride hydroxyl, acrylate, acrylic/CAB, alkyd, acetylacetonate ketamine, acrylic lacquer, vinyl butylaldehyde, epoxy/acid, melamine hydroxyl, silane and the like. Some suitable water-based compositions include isocyanate hydroxyl, epoxy amine, acrylic latex, melamine hydroxyl and the like.

The pressure canister systems of the present invention are suitable for use in many applications. Examples of some suitable applications include automotive refinish, automotive OEM, automotive parts and products, architectural coatings, consumer electronics, appliances, sports and recreation equipment, aerospace and the like. In certain embodiments, the coating compositions may be applied to one or more test panels such as those used in color laboratories and the like.

For purposes of this detailed description, it is to be understood that the invention may assume various alternative variations and step sequences, except where expressly specified to the contrary. Moreover, unless otherwise indicated, all numbers expressing quantities used in the specification and claims are to be understood as being modified in all instances by the term "about". Accordingly, unless indicated to the contrary, the numerical parameters set forth in the following specification and attached claims are approximations that may vary depending upon the desired properties to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances.

It will be readily appreciated by those skilled in the art that modifications may be made to the invention without departing from the concepts disclosed in the foregoing description. Such modifications are to be considered as included within the following claims unless the claims, by their language, expressly state otherwise. Accordingly, the particular embodiments described in detail herein are illustrative only and are not limiting to the scope of the invention which is to be given the full breadth of the appended claims and any and all equivalents thereof.

We claim:

1. A system for pressurized delivery of coating compositions comprising:

a support base structured and arranged to support a container of a coating composition; and a pressure canister positioned above and movable in relation to the support base from an open position to a closed position in which the pressure canister surrounds the coating composition container and forms a seal with the support base, wherein the support base and pressure canister are horizontally movable in relation to each other from a first staging position to a second position in which a support surface of the base supporting the coating composition container is positioned under the pressure canister.

2. The system of claim 1, wherein the pressure canister comprises a lower edge that forms the seal with the support base.

3. The system of claim 1, wherein the support base comprises:

a support surface oriented in a substantially horizontal plane for supporting the coating composition container; and a base sealing surface for sealing against the pressure canister when in the closed position.

4. The system of claim 3, wherein the support surface and base sealing surface are in substantially the same horizontal plane.

5. The system of claim 1, further comprising an elastomeric material on the support base or on the pressure canister forming the seal.

6. The system of claim 5, wherein the elastomeric material comprises an annular ring mounted on the support base that contacts a lower edge of the pressure canister.

7. The system of claim 1, wherein the pressure canister comprises:

a sidewall surrounding the coating composition container; and an integral top positioned over the coating composition container when the pressure canister is in the closed position.

8. The system of claim 7, wherein the sidewall of the pressure canister has a height greater than a height of the coating composition container.

9. The system of claim 1, wherein the pressure canister comprises at least one pressure port extending therethrough for introducing a pressurizing gas into the pressure canister.

10. The system of claim 1, wherein the pressure canister comprises at least one coating composition delivery port extending therethrough for delivering the coating composition from the pressure canister.

11. The system of claim 10, wherein the pressure canister comprises a hollow stem connected to the coating delivery port with a lower end structured and arranged to extract the coating composition from the coating composition container when the pressure canister is in the closed position and a pressurized gas is introduced into the pressure canister.

12. The system of claim 11, wherein the stem is disposable.

13. The system of claim 1, further comprising fasteners for securing the pressure canister in the closed position.

14. The system of claim 13, wherein the fasteners comprise mechanical clamps automatically engagable with the pressure canister to force the pressure canister downward against the support base.

15. The system of claim 1, wherein the support base is movable in a horizontal direction.

16. The system of claim 15, wherein the pressure canister is movable in a vertical direction.

17. The system of claim 16, wherein the pressure canister is movable in the vertical direction from the open position to the closed position.

18. The system of claim 16, further comprising a cleaning fixture mounted on the support base positionable under the pressurized canister when the support base is in the first staging position.

19. The system of claim 18, wherein the pressure canister is movable in the vertical direction to a cleaning position surrounding the cleaning fixture.

20. The system of claim 19, wherein the pressure canister comprises a hollow stem extending downward inside the pressure canister, and the cleaning fixture comprises at least one cleaning fluid delivery nozzle directed at the stem when the pressure canister is in the cleaning position.

21. The system of claim 20, wherein the cleaning fixture comprises a cleaning sleeve extending upward from the support base having an interior cleaning chamber that surrounds at least a portion of the stem.

22. The system of claim 21, wherein the cleaning sleeve and the stem are vertically movable in relation to each other.

23. The system of claim 21, wherein the at least one cleaning fluid delivery nozzle extends through a sidewall of the cleaning sleeve toward the interior cleaning chamber.

24. The system of claim 20, further comprising at least one cleaning fluid delivery tube in fluid flow communication between the at least one cleaning fluid delivery nozzle and a source of cleaning fluid.

25. The system of claim 24, wherein the cleaning fluid comprises a solvent that is the same as a solvent contained in the coating composition.

26. The system of claim 21, further comprising at least one cleaning fluid exit port in fluid flow communication with the interior cleaning chamber of the cleaning sleeve.

27. A system for pressurized delivery of coating compositions comprising a pressure canister automatically movable from a delivery position in which the pressure canister is pressurized for delivery of the coating composition to a cleaning position in which at least a portion of the pressure canister is cleaned by a cleaning fixture, wherein the pressure canister and the cleaning fixture are horizontally movable in relation to each other.

28. An automated method for pressurized delivery of coating compositions comprising:

placing a container of a coating composition on a support base that is in a first staging position;

moving the support base horizontally from the first staging position to a second position under a pressure canister, moving the pressure canister vertically in relation to the support base to a position in which the pressure canister surrounds the coating composition container and forms a seal with the support base;

pressurizing the pressure canister; and delivering the coating composition under pressure from the pressure canister through a hollow stem mounted on the pressure canister and extending into the coating composition container.

* * * * *